United States Patent [19]

Kuhlmann et al.

[11] 4,380,693

[45] Apr. 19, 1983

[54] SWITCHING DEVICE

[75] Inventors: Gerhard Kuhlmann, Stuttgart; Erwin Wolf, Weissach i T.; Günter Wahl, Leinfelden-Echterdingen, all of Fed. Rep. of Germany

[73] Assignee: Robert Bosch GmbH, Stuttgart, Fed. Rep. of Germany

[21] Appl. No.: 266,343

[22] Filed: May 22, 1981

[30] Foreign Application Priority Data

Jun. 25, 1980 [DE] Fed. Rep. of Germany ..... 3023691

[51] Int. Cl.[3] ..... H01H 15/24; H01H 9/24

[52] U.S. Cl. ..... 200/330; 200/157; 200/321; 200/337

[58] Field of Search ..... 200/329, 330, 331, 337, 200/338, 321, 322, 157

[56] References Cited

U.S. PATENT DOCUMENTS 1,592,225 7/1926 Pieper ..... 200/157
3,398,250 8/1968 Bowers ..... 200/157
3,854,020 12/1974 Glover et al. ..... 200/321

FOREIGN PATENT DOCUMENTS 216779 8/1961 Austria ..... 200/157
992792 10/1951 France ..... 200/337

*Primary Examiner*—John W. Shepperd
*Attorney, Agent, or Firm*—Michael J. Striker

[57] ABSTRACT

A switching device has a switch and an actuating member displaceable in switching on and switching off directions and tiltable in engaging and disengaging directions coordinated with one another so that when the actuating member moves in switching on direction and tilts in engaging direction it switches on the switch and is arrested, and when the actuating member moves in switching off direction and disengaging direction it is released and switches off the switch. The actuating member is tiltable about an axis located in a plane which extends between a point of connection with the spring and gripping surfaces provided on the actuating member.

17 Claims, 6 Drawing Figures

SWITCHING DEVICE

BACKGROUND OF THE INVENTION

The present invention relates to a switching device having an actuating member, particularly to a switching device for a hand held power tool.

Switching devices of the above-mentioned general type are known in the art. A known switching device has a switch and an actuating member which displaces in direction of switching on of the switch and is arrested outwardly in the respective position. In order to release the actuating member it is necessary to press the actuating member in direction transverse to the switching off direction toward the housing of the device. Then, the actuating member springs back under the action of a spring force, in a switching off direction so as to switch off the switch. The above-described construction of the actuating member possesses the disadvantage in that its operation requires full concentration of the operator and leads to frequent malfunctions. The reason of this is that the displacement in the switching off direction is unexpected and senseless. The switching on and the switching off must be performed in directions which are opposite to one another. Moreover, for high operational safety it is advisable when the switching on is performed in direction away from the body of the operator, whereas the switching off is performed in direction toward the body of the operator. This conclusion have been made from the observations that in the event of danger a movement away from the tool and toward the body of the operator is instinctively performed.

SUMMARY OF THE INVENTION

Accordingly, it is an object of the present invention to provide a switching device which avoids the disadvantages of the prior art.

More particularly, it is an object of the present invention to provide a switching device which is characterized by fast and safety operation of an actuating member both for switching on and a switching off of a switch associated therewith.

In keeping with these objects and with others which will become apparent hereinafter, one feature of the present invention resides, briefly stated, in a switching device having a switch and an actuating member, in which the actuating member is displaceable in a switching on direction and tiltable in an engaging direction coordinated with the switching on direction, and is also displaceable in a switching off direction and tiltable in a disengaging direction coordinating with the switching off direction.

When the switching device is designed in accordance with the present invention, the directions of the switching on and engaging, on the one hand, and the directions of the switching off and disengaging, on the other hand, substantially coincide with one another. This guarantees a fast operation of the device and a safety manipulation therewith by the operator. The above-mentioned movements are reasonably coordinated with one another and correspond to the instinctive feelings of the operator.

In accordance with another advantageous feature of the present invention, the above-mentioned coordination of the movement is attained by a construction in which the actuating member is tiltable about an axis which is located in a plane extending between a point of connection of a spring to the actuating member and gripping surfaces provided on the actuating member for displacing the latter in the switching on and the switching off directions.

In accordance with another advantageous feature of the present invention, the gripping surfaces are arranged at two opposite sides of a plane which contains the axis of tilting of the actuating member and is at least approximately normal to the plane in which the actuating member displaces between the switching on and switching off positions.

The actuating member may be provided with an arresting formation arranged at one side of the tilting axis and with an additional gripping surface arranged to press the actuating member toward guiding element and provided at the opposite side of the tilting axis.

The gripping surfaces of the actuating member may be inclined to the plane of displacement of the latter. The above-mentioned additional gripping surface may also be inclined to the plane of displacement of the actuating member at an angle which corresponds to the angle of inclination of the first-mentioned gripping surface.

The axis of tilting may be formed by a contact edge defined between two inclined supporting surfaces of the actuating member, the supporting surfaces cooperating with a flat supporting surface of the guiding element. On the other hand, the axis of tilting may be formed by a projection provided on the guiding element and cooperating with a flat supporting surface of the actuating member. This projection may be formed as a fin, a bead and the like.

The actuating member may be provided with an arresting projection which is engageble in an arresting recess of the guiding element, the arresting recess being formed as a depression, a throughgoing opening and the like.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figures 1, 1A, 1B, 2, 2A, 2B, 3, 3A, 3B:
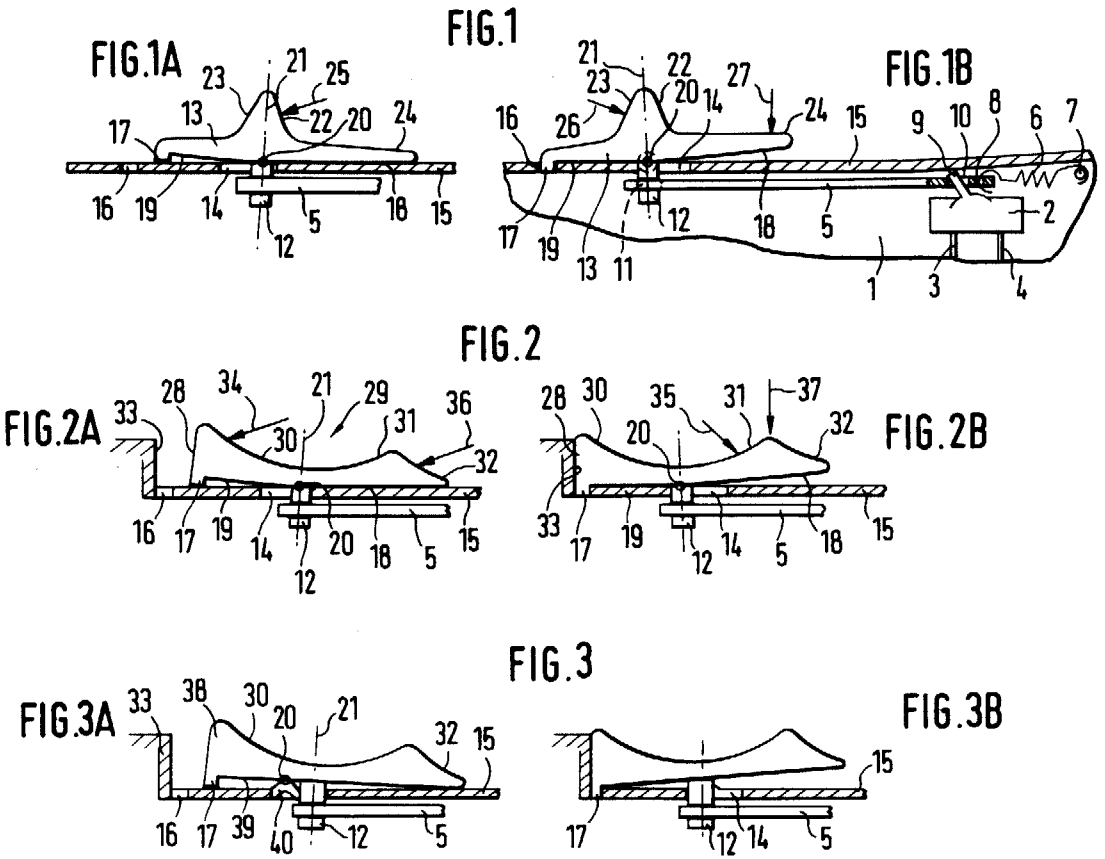
FIG. 1 with FIGS. 1*a* and 1*b* a switching device with an actuating member in a switching off position and a switching on position, respectively, in accordance with the present invention.
FIG. 2 with its
FIGS. 2*a* and 2*b* are views substantially corresponding to the views shown in the above-mentioned Figures but illustrating a switching device in accordance with a second embodiment of the invention.
FIG. 3 with its
FIGS. 3*a* and 3*b* are views substantially corresponding to the above-mentioned views but showing the switching device in accordance with still a further embodiment of the present invention.

A switching device in accordance with the present invention is associated with a hand held power tool having a housing 1 and a switch 2. The switch 2 has conductors 3 and 4, a rod 5, a tension spring 6, and a bearing pin 7.

The rod 5 has one end provided with an opening 8, and a free end of the tension spring 6 engages in this opening. A further opening 10 is also provided at this end of the rod 5, and a switching finger 9 of the switch 2 extends through the opening 10. The rod 5 has an opposite end which is spaced from the switch 2 and has an opening 11. A driving pin 12 of an actuating member 13 extends through the opening 11 of the rod 5.

The housing 11 of the tool has a wall 15 with an outer surface for supporting the actuating member 13. The wall 15 has a guiding slot 14 through which the driving pin 12 extends. The wall 15 has also an arresting opening 16 in which an arresting projection 17 of the actuating member 13 can engage. The actuating member 13 shown in FIG. 1 has two supporting surfaces 18 and 19 which are inclined toward one another and arranged to abut against the outer surface of the wall 15. The inclined supporting surfaces merge into one another so as form a contact edge which together with the outer surface of the wall 15 form an axis of tilting 20. A plane 21 which is indentified by dotted lines extends through the axis of tilting 20 and through the center line of the driving pin 12.

The actuating member 13 has a face which faces away from the wall 15 and is provided with two gripping surfaces 22 and 23. The gripping surfaces 22 and 23 are located at opposite sides of the plane 21 opposite to one another and inclined relative to one another. The above-mentioned face of the actuating member 13 also forms an additional surface 24 which is located relative to the axis of tilting 20 at a side which is opposite to the side at which the arresting projection 17 is located. The additional gripping surface 24 is suitable for applying an operational pressure toward the wall 15.

The switching device shown in FIGS. 1, 1*a*, and 1*b* operates in the following manner:

In inoperative position, the tension spring 6 holds the switching pin 9 via the rod 5 in switching off position of the switch 2. The actuating member is retained, via the rod 5 and the driving pin 12, in its switching off position corresponding to the switching off position of the switching pin 9 (FIG. 1*a*). For switching on the switch 2, the operator must press the actuating member against the gripping surface 22 in direction of the arrow 25. Thereby, the force of the tension spring 6 is overcome and the switching pin 9 is displaced via the rod 5 in its switching on position. When the switching on is attained, the actuating member 13 tilts under the same pressure against the gripping surface 22 and engages with its arresting projection 17 into the arresting opening 16 in the wall 15 (FIG. 1*b*). When the actuating member 13 is released, the force of the tension spring 6 maintains the arresting projection 17 in switching on position and maintains the switch 2 in switching on condition during the operation. For switching off of the hand-held power tool, the operator presses against the gripping surface 23 in direction of the arrow 26. The lever action which is thereby generated tilts the actuating member 13 about the axis of tilting 20 and lifts the arresting projections 17 out of the arresting opening 16. Under the action of the continuing pressure against the gripping surface 23 and the force of the tension spring 6, the actuating member 13 and the switching pin 9 with the rod 5 displace back in their initial position. The switch 2 is again switched off. In the construction shown in these Figures, the actuating member 13 can also be switched off by applying pressure in direction of the arrow 27 against the additional gripping surface 24. The actuating member 13 is also tilted about its axis of tilting 20 and the arresting projection 17 is lifted out of the arresting opening 16. It suffices to overcome the force of the tension spring 6, and the actuating member 13, the switching pin 9 and the rod 5 displace in their initial position.

The switching device shown in FIG. 2 with FIGS. 2*a* and 2*b* includes an actuating member which is identified by reference numeral 28. The actuating member 28 differs from the actuating member 13 of the first embodiment in the fact that the actuating member 28 has a trough-shaped depression 29 with gripping surfaces 30 and 31. The gripping surfaces 30 and 31 are located opposite to one another, inclined toward one another and arranged at opposite sides of the plane 21 in which the axis of tilting 20 is located. An additional gripping surface 32 provided on the actuating member 28 is inclined stronger to the plane of displacement of the actuating member 28 than the additional gripping surface 24 of the actuating member 13. The wall 15 of the housing 1 forms a step 33 arranged behind the arresting opening 16.

The switching device provided with the actuating member 28 in accordance with the second embodiment operates in the following manner:

For switching on of the switch 2, the operator presses the actuating member against the gripping surface 30 in direction of the arrow 34 or against the gripping surface 32 in direction of the arrow 36. When the pressure is applied against the gripping surface 30, the switching on process takes place which is similar to that described in connection with FIG. 1. The actuating member 28 displaces the switching pin 9 via the rod 5 against the action of the tension spring 6, until it tilts and its arresting projection 17 engages in the arresting opening 16 (FIG. 2*b*). For switching off, the operator presses the actuating member 28 against the gripping surface 31 in direction of the arrow 35 and provides for the action which is identical to the action provided by the pressure against the gripping surface 23 in the direction of the arrow 26 of the actuating member 13. When the pressure is applied in direction of the arrow 36, against the boundary surface between the gripping surfaces 31 and 32, the operator obtains the same results as during pressing against the additional gripping surface 24 of the actuating member 13.

When for switching on the operator presses the actuating member 28 against the additional gripping surface 32 in direction of the arrow 36 the actuating member 28 is displaced by such a distance that it abuts against the step 33 of the wall 15 of the housing 1. The arresting projection 16 does not engage in the arresting opening 16. When the operator slowly releases the finger, the actuating member 28 displaces under the action of the tension spring 6 so that the switch 2 is again switched off. This function of the actuating member 28 can be obtained by the actuating member 13 only in the event when the operator presses simultaneously against the gripping surface 22 and the additional gripping surface 24.

The switching device shown in FIG. 3 with its FIGS. 3*a* and 3*b* has an actuating member which is identified by reference numeral 38. The actuating member 38 differs from the actuating member 24 in the fact that the lower face of the actuating member 38 which faces toward the wall 15 is formed as a single flat surface 39. The axis of tilting 20 for the actuating member 38 is formed here by a contact line of the surface 39 and a cooperating projection 40 of the wall 15. The projection 40 may be formed as a fin, a bead, and the like. The projection 40 is formed near the guiding slot 14 at its end facing toward the switching on position. The projection 40 may be stamped out from the material of the wall 15 at both sides of the guiding slot 14. The operation of the actuating member 38 corresponds to the operation of the actuating member 28.

The switching device in accordance with all three embodiments of the invention provides for very simple means for actuation of hand held power tools as safely as possible.

It will be understood that each of the elements described above, or two or more together, may also find a useful application in other types of constructions differing from the types described above.

While the invention has been illustrated and described as embodied in a switching device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting featres that, from the standpoint of prior art, fairly constitute essential characteristics of the generic or specific aspects of the present invention.

What is claimed as new and desired to be protected by Letters Patent is set forth in the appended claims:

1. A switching device, comprising a switch; an actuating member displaceable in a switching-on direction so as to switch on said switch and also displaceable under the action of a spring force in a switching-off direction so as to switch off said switch, said actuating member being also tiltable, upon displacement in the switching-on direction, to an engaging position for arresting said actuating member and to a disengaging position for releasing said actuating member, so that when said actuating member is displaced in said switching-on direction and to said engaging position it switches on said switch and is arrested and when said actuating member is tilted to said disengaging position and displaced in said switching-off direction it is released and switches off said switch; means for spring biasing said actuating member in said switching-off direction;

means for holding said actuating member in said engaging position; and means for mounting said actuating member for displacement and tilting.

2. A switching device as defined in claim 1, wherein said spring biasing means is connected with said actuating member in a connecting point, said actuating member having two gripping surfaces arranged to be acted upon during said displacement in said switching-on direction and tilting to said engaging position and during said displacement in said switching off direction and tilting to said disengaging position, respectively, said actuating member being tiltable about an axis located in a plane which extends between said connecting point and said gripping surfaces.

3. A switching device as defined in claim 2, wherein said actuating member is displaceable between said switching-on and switching-off positions in a second plane, said gripping surfaces being arranged at two opposite sides of a third plane which contains said axis of tilting and is at least approximately normal to said second plane of displacement.

4. A switching device as defined in claim 3; and further comprising a guiding element for guiding said actuating member during displacement, said actuating member having a first end located at one side of said axis of tilting and provided with an arresting formation and another end located at the opposite side of said axis of tilting and provided with an additional gripping surface arranged to press said actuating member toward said guiding element.

5. A switching device as defined in claim 4, wherein said actuating member is displaceable between said switching-on and switching-off positions in a second plane, said gripping surfaces being inclined to said second plane of displacement by a predetermined angle, said additional gripping surface being inclined toward said second plane of displacement by the same angle.

6. A switching device as defined in claim 2, wherein said actuating member is displaceable between said switching-on and switching-off positions in a second plane, said gripping surfaces being inclined to said second plane of displacement.

7. A switching device as defined in claim 2, wherein said actuating member has two first supporting surfaces which are inclined to one another and form a contact edge therebetween, said axis of tilting being formed by said contact edge.

8. A switching device as defined in claim 7; and further comprising a guiding element for guiding said actuating member during said displacement, said guiding element having a flat second supporting surface with which said first supporting surfaces of said actuating member alternately cooperate during said tilting.

9. A switching device as defined in claim 2; and further comprising a guiding element for guiding said actuating member during said displacement, said guiding element having a projection extending toward said actuating member and forming said axis of tilting.

10. A switching device as defined in claim 9, wherein said actuating member has a first supporting surface which is flat and cooperates with said projection of said guiding element so that said actuating member tilts about said axis of tilting formed by said projection.

11. A switching device as defined in claim 9, wherein said projection of said guiding element is formed as a fin.

12. A switching device as defined in claim 9, wherein said projection of said guiding element is formed as a bead.

13. A switching device as defined in claim 1, and further comprising a guiding element for guiding said actuating member during said displacement, said actuating member having a first formation and said guiding element having a second formation which engage one another so as to arrest said actuating member when it switches on said switch, said formations forming said holding means.

14. A switching device as defined in claim 13, wherein said formations include an arresting projection and an arresting recess in which said arresting projection engages.

15. A switching device as defined in claim 14, wherein said actuating member has a side facing toward said guiding element and is provided at said side with said arresting projection, said guiding element being provided with said arresting recess.

16. A switching device as defined in claim 14, wherein said arresting recess is formed as a depression.

17. A switching device as defined in claim 14, wherein said arresting recess is formed as a throughgoing opening.

* * * * *